US008016592B2

(12) United States Patent
Fan

(10) Patent No.: US 8,016,592 B2
(45) Date of Patent: Sep. 13, 2011

(54) METHOD AND SYSTEM FOR THERMAL PROCESSING OF OBJECTS IN CHAMBERS

(75) Inventor: Chun Wah Fan, Hong Kong (CN)

(73) Assignee: Dongguan Anwell Digital Machinery Ltd., Guangdong (CN)

( * ) Notice: Subject to any disclaimer, the term of this patent is extended or adjusted under 35 U.S.C. 154(b) by 842 days.

(21) Appl. No.: 12/013,408

(22) Filed: Jan. 11, 2008

(65) Prior Publication Data

US 2009/0170047 A1 Jul. 2, 2009

Related U.S. Application Data

(63) Continuation-in-part of application No. 11/968,188, filed on Jan. 1, 2008.

(51) Int. Cl.
*F27D 3/00* (2006.01)

(52) U.S. Cl. ..... 432/239; 432/243; 432/128; 438/716

(58) Field of Classification Search ..... 432/6, 239, 432/243, 246, 247, 128; 414/936, 938, 940, 414/937; 438/716
See application file for complete search history.

(56) References Cited

U.S. PATENT DOCUMENTS 3,737,282 A * 6/1973 Hearn et al. ..... 438/795
4,439,146 A * 3/1984 Sugita ..... 432/253
4,949,848 A * 8/1990 Kos ..... 211/41.18
5,277,579 A * 1/1994 Takanabe ..... 432/5
5,378,145 A * 1/1995 Ono et al. ..... 432/152
5,404,894 A * 4/1995 Shiraiwa ..... 134/66
5,474,410 A * 12/1995 Ozawa et al. ..... 414/217
5,639,234 A * 6/1997 Ono et al. ..... 432/152
5,740,034 A * 4/1998 Saeki ..... 700/59
6,007,675 A * 12/1999 Toshima ..... 156/345.32
6,511,315 B2 * 1/2003 Hashimoto ..... 432/121
6,835,039 B2 * 12/2004 van den Berg et al. ..... 414/217
6,905,972 B2 * 6/2005 Oda ..... 438/716
2003/0053893 A1 * 3/2003 Matsunaga et al. ..... 414/217

* cited by examiner

*Primary Examiner* — Gregory A Wilson
(74) *Attorney, Agent, or Firm* — Joe Zheng

(57) ABSTRACT

A thermal processing system is disclosed. The thermal processing system includes a transfer stage, one or more thermal processing chambers and an interface to a deposition equipment. The transfer stage is provided to receive workpieces for thermal processing. Further the transfer stage is provided as a mechanism to move workpieces from one chamber to another chamber. The thermal processing chamber includes a heat manipulation system to heat up or cool down the workpieces. The thermal processing chamber is designed to accommodate a platform that positions each of the workpieces vertically. As a result, all workpieces are moved together with the platform to be transferred, for example, from one chamber to another chamber. Depending on implementation, the platform may be implemented to include a fixture or a plurality of fixtures, where all of the workpieces may be removably held up by the fixture or each of the workpieces is removably held up by one of the fixtures.

9 Claims, 7 Drawing Sheets

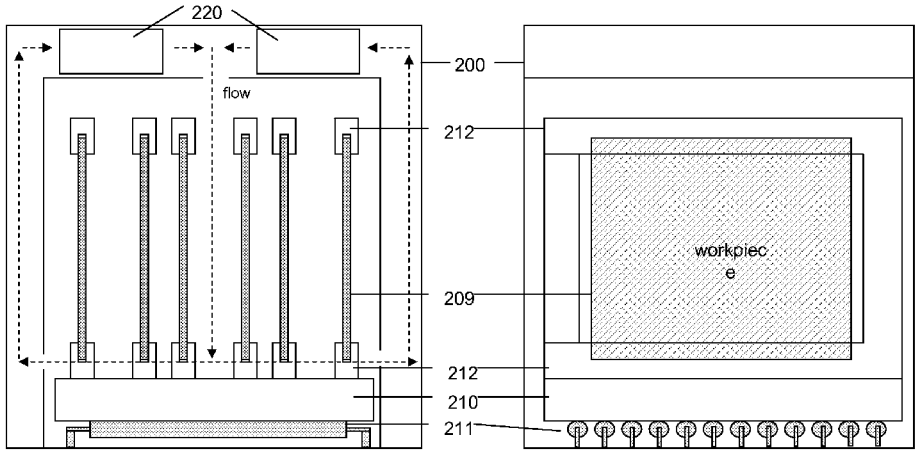
FIG. 2A
FIG. 2B
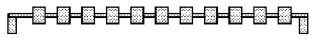
FIG. 2C

METHOD AND SYSTEM FOR THERMAL PROCESSING OF OBJECTS IN CHAMBERS

CROSS-REFERENCE TO RELATED APPLICATIONS

This application is a continuation-in-part of co-pending U.S. patent application Ser. No. 11/968,188, entitled "Method and system for handling objects in chambers", filed on Jan. 1, 2008.

BACKGROUND OF THE INVENTION

Field of the Invention

The invention is generally related to the area of thermal processing of multiple workpieces before and after thin-film deposition. More specially, the present invention is related to method and system for handling multiple workpieces from one chamber to another chamber, wherein the workpieces are being transferred, treated or processed in the chamber.

SUMMARY OF THE INVENTION

This section is for the purpose of summarizing some aspects of the present invention and to briefly introduce some preferred embodiments. Simplifications or omissions in this section as well as in the abstract or the title of this description may be made to avoid obscuring the purpose of this section, the abstract and the title. Such simplifications or omissions are not intended to limit the scope of the present invention.

In general, the present invention pertains to techniques for transferring workpieces from one chamber to another chamber. According to one aspect of the present invention, a thermal processing system includes a transfer stage, one or more thermal processing chambers and interface to deposition equipment. A transfer stage is provided to receive workpieces for thermal processing. Further the transfer stage is provided as a mechanism to move workpieces from one chamber to another chamber. The thermal processing chamber includes a heat manipulation system to heat up or cool down the workpieces. The thermal processing chamber is designed to accommodate a platform that positions each of the workpieces vertically. As a result, all workpieces are moved with the platform to be transferred, for example, from one chamber to another chamber. Depending on implementation, the platform may be implemented to include a fixture or a plurality of fixtures, where all of the workpieces may be removably held up by the fixture or each of the workpieces is removably held up by one of the fixtures. A moving mechanism is provided to facilitate the platform or fixture(s) to be moved from one place to another (e.g., the transfer stage, a thermal processing chamber and a deposition equipment).

According to another aspect of the present invention, the moving mechanism includes rollers, wheels running in rails and a transfer device, and studs and a manipulator. With a mechanical maneuver, the fixture(s) can be moved to a designated chamber through the moving mechanism.

The present invention may be implemented as a method, an apparatus, a system or a part of system. According to one embodiment, the present invention is a system for handling workpieces, the system comprises: a transfer stage, a thermal processing chamber, a deposition equipment, and a fixture that is removably positioned in the transfer stage and the thermal processing chamber to hold a plurality of workpieces vertically.

According to another embodiment, the present invention is a system for handling workpieces in chambers, the system comprises: a transfer stage for receiving the workpieces, wherein fixtures are used to hold the workpieces vertically apart; the transfer stage including a rotary stage mounted with a transferring mechanism; at least a thermal processing chamber. The transferring mechanism in the transfer stage is used to transfer the fixture to the thermal processing chamber and the deposition equipment.

The present invention may be used in a number of applications. One of them is to manipulate the temperature of workpieces before and after treatment in the deposition equipment. When system throughput is to be increased, an additional thermal processing chamber may be provided. The transfer stage may be used to efficiently transfer the workpieces in between the transfer stage, the thermal processing chamber and the deposition equipment.

One of the objects, features, and advantages of the present invention is to provide a system for handling workpieces efficiently.

Objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will become better understood with regard to the following description, appended claims, and accompanying drawings where:

FIG. 2A and FIG. 2B show respectively a front view and a cross sectional view of a fixture and can be used in the configuration of FIG. 1;

FIG. 2C shows an implementation of a roller that can be also used in the configuration in FIG. 2A.

DETAILED DESCRIPTION OF THE PREFERRED EMBODIMENTS

The detailed description of the present invention is presented largely in terms of procedures, steps, logic blocks, processing, or other symbolic representations that directly or indirectly resemble the handling of workpieces in a system. These descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams or the use of sequence numbers representing one or more embodiments of the invention do not inherently indicate any particular order nor imply any limitations in the invention.

Figure 1:
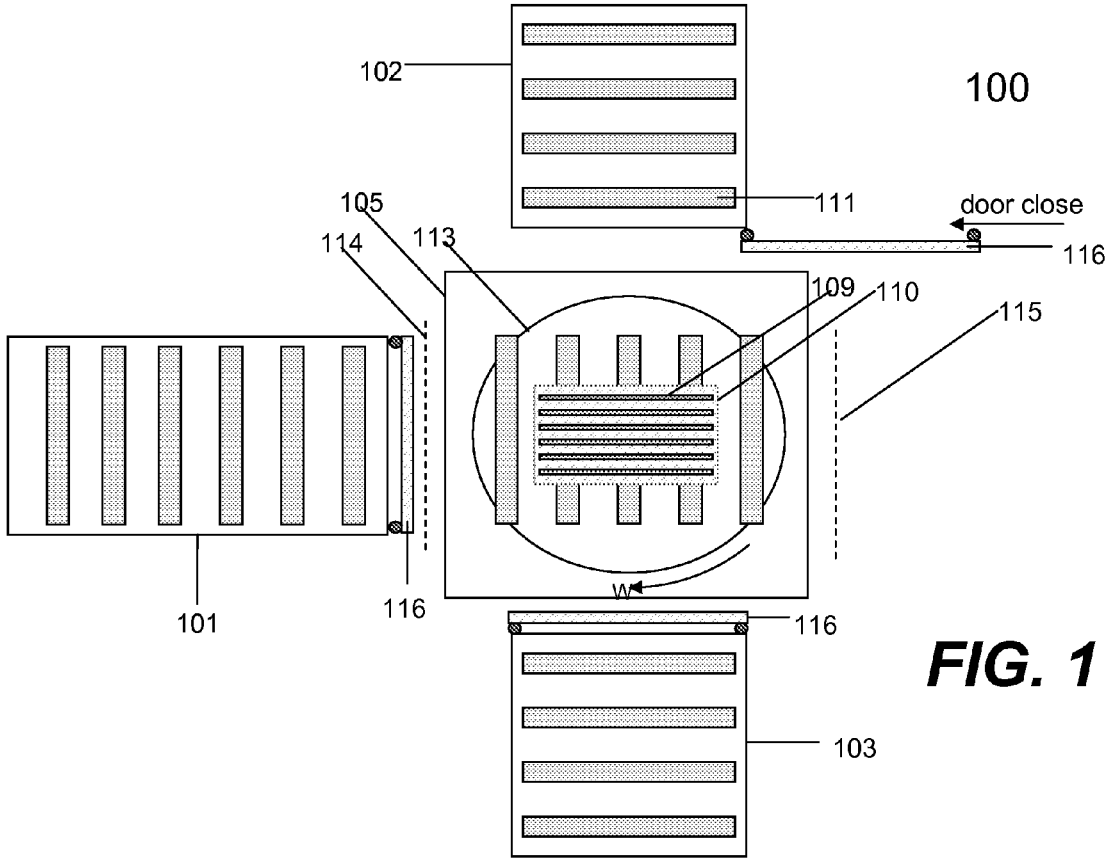
FIG. 1 shows an exemplary configuration according to one embodiment of the present invention.

Referring now to the drawings, in which like numerals refer to like parts throughout the several views. FIG. 1 shows an exemplary configuration 100 according to one embodiment of the present invention. The configuration 100 includes a transfer stage 105, one or more thermal process chambers (only two representative chambers 102, 103) and one or more deposition equipment (only one representative 101 is shown). The transfer stage 105 is used for receiving objects or workpieces and getting them ready for loading into one of the thermal processing chambers or the deposition equipment. The transfer stage is also used for unloading of workpieces after treatment by the thermal processing chamber and the deposition equipment.

According to one embodiment, the transfer stage 105 includes a rotary stage 113 that turns around to align with one of the thermal processing chambers or the deposition equipment to load or unload the workpieces. Depending on the implementation, the thermal processing chambers may be designed identically or each of the thermal process chambers may be configured to treat the workpieces differently. For example, in one embodiment, all available thermal processing chambers may be equipped with heating and cooling facility. In another embodiment, some of the thermal processing chambers are equipped with heating facility while some others are equipped with cooling facilities. Thus a thermal processing chamber is used to heat the workpieces with a first temperature before treatment by the deposition equipment, a second thermal processing chamber is used to cool the workpieces after treatment by the deposition equipment. The transfer stage 105 may be used to transfer the workpieces from one place to another, for example, first transferring the workpieces to the first thermal processing chamber, and then to the deposition equipment before the workpieces are transferred to the second thermal processing chamber.

In one exemplary operation, a platform on the rotary stage 113 is rotated to the loading interface 115 for loading of workpieces. An array of workpieces is removably positioned in a platform that may be moved in or out a chamber through a moving mechanism. The platform includes at least a fixture 110 that is loaded by the transfer stage 105 into a thermal processing chamber 102 for heating to a first temperature. After the workpieces are processed, they are unloaded from the thermal processing chamber to the rotary stage on the transfer stage. The rotary stage then rotates to a piece of deposition equipment 101 to transfer the fixture therein. After the workpieces are processed by the deposition equipment 101, they are unloaded to the transfer stage 115. Then the rotary stage rotates to a thermal processing chamber 103 for cooling down to a second temperature. After the workpieces are cooled to a second temperature, they are unloaded from the thermal processing chamber into the transfer stage. The transfer stage rotates to the load/unload interface for unload of workpiece. The workpiece are subsequently unloaded through the load/unload interface. Depending on the implementation, the platform may be designed in different forms. Some exemplary platforms will be described below.

FIG. 2A and FIG. 2B show respectively a front view and a cross sectional view of a thermal processing chamber 200. According to one embodiment, a platform includes a fixture 210 and an array of rollers 211, where the fixture 210 is landed on the rollers 211. To allow for parallel handling of the workpieces, one fixture can hold a number of workpieces. The fixture 210, as shown, includes six sets of holders 212, each set designed to hold one of the workpieces to be treated in the process chamber. A pair of holders 212 is explicitly shown to hold a workpiece 209 in FIG. 2B. The fixture 210 allows all workpieces being held to be moved in or out, or between the thermal process chambers simultaneously.

To transfer the fixtures 210 from the transfer stage to a thermal processing chamber or a piece of deposition equipment, the rotary stage 113 of the transfer stage 105 is rotated until the rollers in the transfer chamber are aligned with the rollers in the thermal processing chamber 102 or the deposition equipment 101. Once aligned, the rollers are activated such that the fixture(s) is transferred in or out of the thermal processing chamber 102 or the deposition equipment 101. The rollers are stopped when the fixture reached a designated position inside the thermal processing chamber or the deposition equipment. The door 116 on the thermal processing chamber or the deposition equipment is subsequently closed to isolate the interior of the thermal processing chamber or the deposition equipments from the ambient.

Figures 3A, 3B:
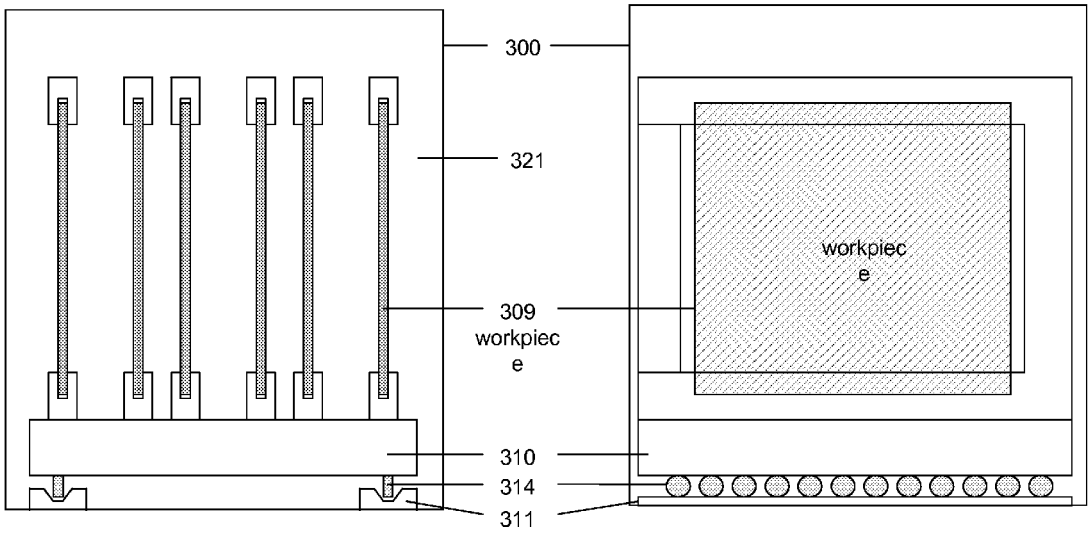
FIG. 3A and FIG. 3B show respectively a front view and a cross sectional view a fixture with wheels running on a set of rails, and can also be used in the configuration of FIG. 1.

FIG. 2A, 2B, shows that the fixture(s) is moved or transferred by an array of rollers or sets of rollers. FIG. 2A shows an exemplary implementation of a roller in which a single piece of long tube is mounted to a shaft to form a roller. FIG. 2C shows another exemplary implementation in which a plurality of short tubes (wheels) is mounted to a shaft to form a roller. Depending on implementation, there are other moving mechanisms that may be used to move a platform or fixture(s). One exemplary moving mechanism is to use rails to transfer the fixture(s). FIG. 3A and FIG. 3B show respectively a front view and a cross sectional view of a thermal processing chamber 300 that includes a fixture 310 with wheels 314 running on a set of rails 311. Similar rails may be also provided in the transfer stage or the deposition equipment so that the fixture 310 can be transferred among the transfer stage, the thermal processing chamber and the deposition equipment.

Figure 4:
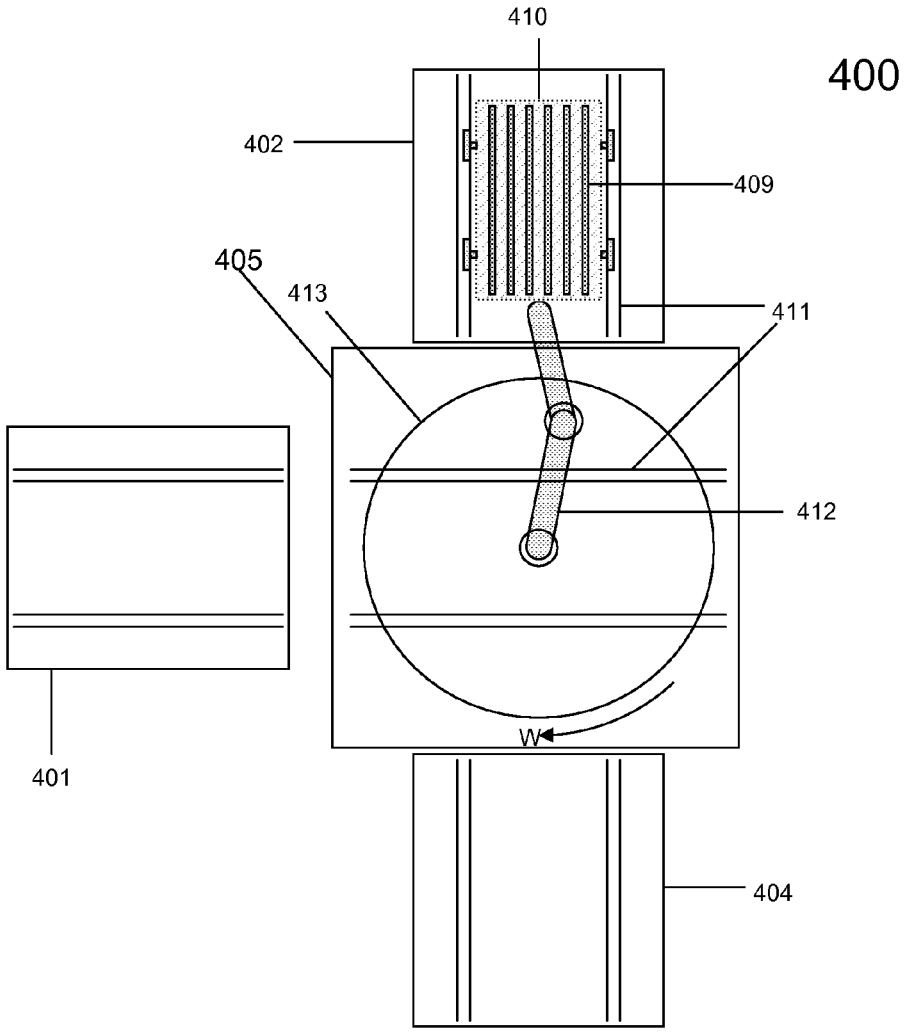
FIG. 4 shows an exemplary configuration using a transfer device to move a fixture horizontally.

FIG. 4 shows an exemplary configuration 400 using a transfer device 412 to move a fixture in between the transfer stage 405, the thermal processing chamber (402, 404) and the deposition equipment 401. According to one embodiment of the present invention, the configuration 400 includes a transfer stage 405, one or more thermal process chambers (only two representative chambers 402, 404) and one or more deposition equipment (only one representative 401 is shown).

In one embodiment, to move the fixture among the thermal processing chamber, the transfer stage and the deposition equipment, the transfer device is a mechanical arm extended towards the fixture and then attached to the fixture. The mechanical arm is then retracted towards transfer stage while still attached to the fixture. As a result, the fixture is moved out of the thermal processing chamber or the deposition equipment, and moved into the transfer chamber along the rails in the horizontal direction, where it is assumed that the rails are aligned by the rotary stage 413. After the fixture is moved into the transfer chamber, the rotary stage is rotated until the rails are aligned with the destination thermal processing chamber or the deposition equipment. The mechanical arm is then extended towards the destination thermal processing chamber or the deposition equipment. As a result, the fixture is moved out of the transfer stage and moved into the destination thermal processing chamber or the deposition equipment. After the fixture is placed at the designated position, the mechanical arm is detached from the fixture and retracts back.

Figures 5A, 5B:
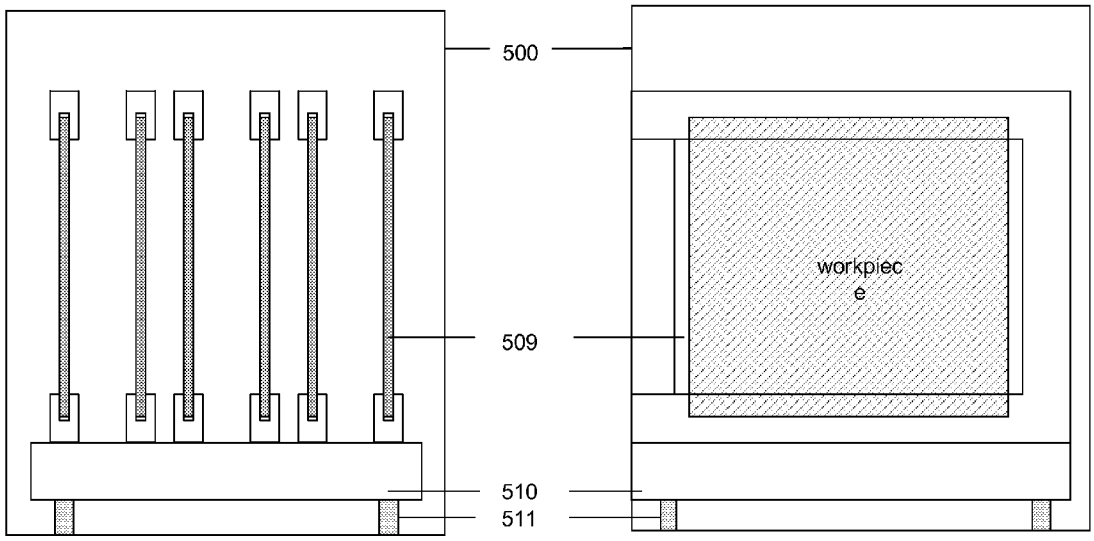
FIGS. 5A and 5B show respectively a front view and a cross sectional view of a fixture placed on a set of studs.

According to another embodiment, a mechanical manipulator is used to move the fixture. FIGS. 5A and 5B show respectively a front view and a cross sectional view of a thermal processing chamber 500 that includes a fixture 510. The fixture 510 is landed on a set of studs 511 that provides a space for the mechanical manipulator (e.g., a lifting mechanism) to extend towards the bottom of the fixture 510.

Figure 6:
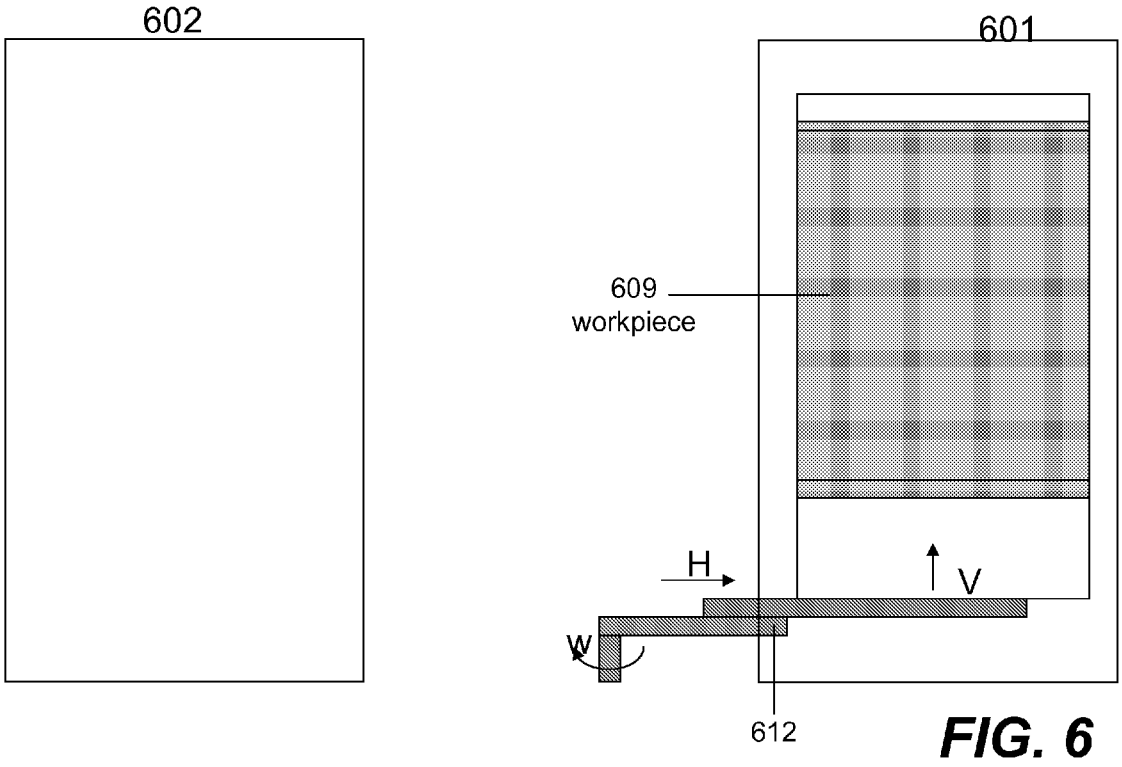
FIG. 6 shows a view of using a manipulator (e.g., a mechanical arm) to raise a fixture to move from one chamber to another.

To move the fixture from the transfer stage to a thermal processing chamber or the deposition equipment, the lifting mechanism holding the fixture is rotated until the fixture is aligned with the process chamber or the deposition equipment. Then, as shown in FIG. 6, the lifting mechanism 612 is extended towards the designated location. When the fixture reaches the designated position location, the lifting mechanism is lowered and the fixture is placed in the designated chamber. The lifting mechanism is then retracted from the designated location into the transfer stage.

According to one embodiment as shown in FIG. 2A, there is a circulating facility 220 provided to drive a medium (e.g. air, nitrogen or a kind of gas) to circulate through the workpieces to heat or cool the workpieces to a desire temperature.

Figure 7:
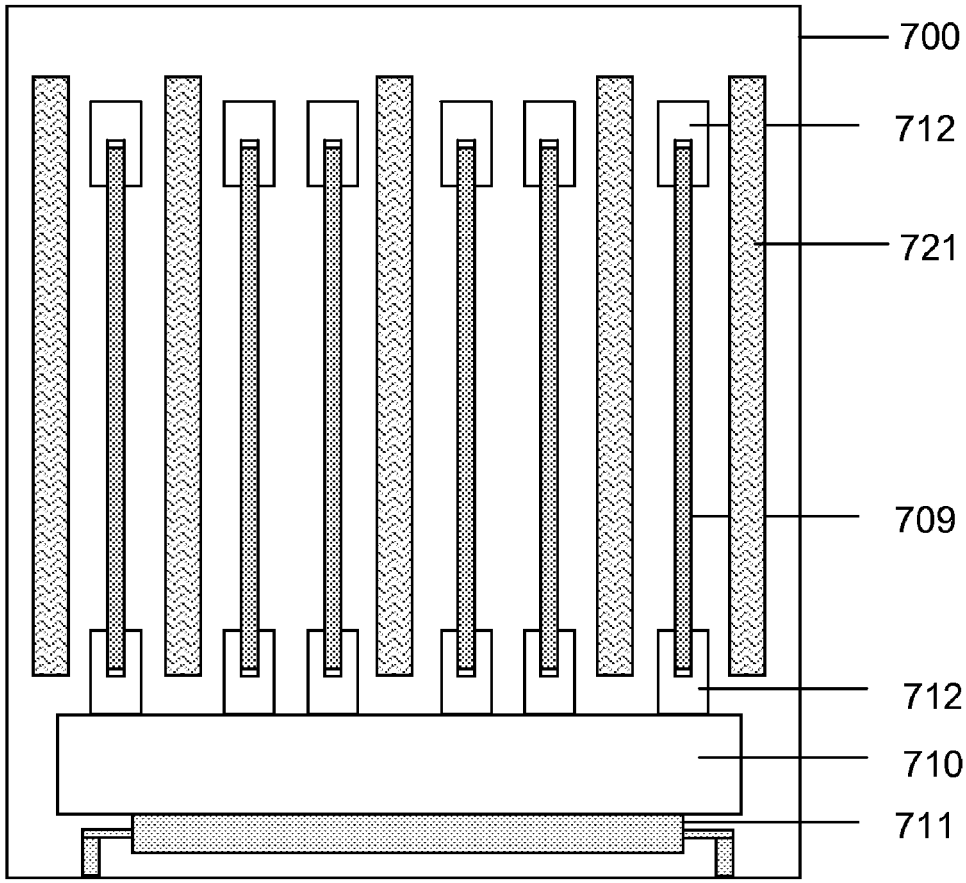
FIG. 7 shows a front view of a thermal processing chamber with heaters or coolers.

According to another embodiment as shown in FIG. 7, heaters 721 are mounted besides the workpieces to heat the workpieces to a desired temperature. Alternatively, coolers may also be placed towards the workpieces to cool down the workpieces to a desired temperature.

The present invention discloses a system for handling of workpieces for thermal processing. The invention may be used in many applications, such as pre-deposition heating and post-deposition cooling down in plasma enhanced chemical vapor deposition (PECVD) that is a process mainly to deposit thin films from a gas state (vapor) to a solid state on some substrate.

The present invention has been described in sufficient details with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

I claim:

1. A system for thermal processing of workpieces, the system comprising:

a platform, including at least one fixture, that is removably positioned in a transfer stage to hold a plurality of workpieces, wherein each of the workpieces is held up vertically;

a first thermal processing chamber to receive the platform, wherein the workpieces are processed therein to a first temperature;

a piece of deposition equipment that is designed to process the workpieces after the workpieces are processed in the first thermal processing chamber;

a transfer stage for transferring the platform in or out of the first thermal processing chamber;

a second thermal processing chamber to receive the platform, wherein the workpieces are processed therein to a second temperature, the transfer stage is designed to transfer the platform out of the first thermal processing chamber for treatment with the deposition equipment, and into the second thermal processing chamber after the workpieces are treated with the deposition equipment;

a first facility is provided to circulate a medium used to heat the workpiece in the first thermal processing chamber; and a second facility is provided to circulate a medium used to cool the workpiece in the second thermal processing chamber.

2. The system as recited in claim 1, further comprising a mechanism provided to transfer the platform in and out of the first thermal processing chamber, the second thermal processing chamber and the deposition equipment.

3. The system as recited in claim 2, wherein the platform is transferred using rollers.

4. The system as recited in claim 2, wherein the platform is transferred using rails.

5. The system as recited in claim 2, further comprising a transfer device which provides a horizontal movement for transporting the fixture.

6. The system as recited in claim 2, further comprising a mechanical manipulator provided to move the platform in and out of a chamber, where functions of the manipulator include:

raising the platform;

moving the platform in the horizontal direction;

rotating the platform about a vertical axis.

7. A system for thermal processing of workpieces, the system comprising:

a platform, including at least one fixture, that is removably positioned in a transfer stage to hold a plurality of workpieces; and a first thermal processing chamber to receive the platform, wherein a first facility is provided to circulate a medium used to heat the workpiece in the first thermal processing chamber;

a transfer stage for transferring the platform in or out of the thermal processing chamber;

a second thermal processing chamber to receive the platform, wherein a second facility is provided to circulate a medium used to cool the workpiece in the second thermal processing chamber; and a piece of deposition equipment that is designed to process the workpieces after the workpieces are processed in the first thermal processing chamber, the transfer stage is designed to transfer the platform out of the first thermal processing chamber for treatment with the deposition equipment, and into the second thermal processing chamber after the workpieces are treated with the deposition equipment.

8. The system as recited in claim 7, further comprising a mechanism provided to transfer the platform in and out of the first thermal processing chamber, the second thermal processing chamber and the deposition equipment.

9. The system as recited in claim 7, further comprising a mechanical manipulator provided to move the platform in and out of a chamber, where functions of the manipulator include:

raising the platform;

moving the platform in the horizontal direction;

rotating the platform about a vertical axis.

* * * * *